United States Patent [19]

Pieczykolan

[11] Patent Number: 4,508,175

[45] Date of Patent: Apr. 2, 1985

[54] FLUSH PENDANT OR FLUSH HORIZONTAL AUTOMATIC SPRINKLER HEAD

[75] Inventor: George S. Pieczykolan, North Wales, Pa.

[73] Assignee: Central Sprinkler Corporation, Lansdale, Pa.

[21] Appl. No.: 460,289

[22] Filed: Jan. 24, 1983

Related U.S. Application Data

[63] Continuation-in-part of Ser. No. 440,539, Nov. 10, 1982.

[51] Int. Cl.[3] ..... A62C 37/00

[52] U.S. Cl. ..... 169/38

[58] Field of Search ..... 169/37, 38, 41, 42

[56] References Cited

U.S. PATENT DOCUMENTS 3,714,989 2/1973 Gloeckler ..... 169/42

4,015,665 4/1977 Simons et al. ..... 169/42

*Primary Examiner*—Jeffrey V. Nase

*Assistant Examiner*—Jon M. Rastello

*Attorney, Agent, or Firm*—Seidel, Gonda, Goldhammer

[57] ABSTRACT

An automatic sprinkler head is disclosed for the discharge of water for extinguishing a fire in which the delivery of water through the head is controlled by a fusible element, but with improved provisions for preventing fluid leakage.

12 Claims, 4 Drawing Figures

FLUSH PENDANT OR FLUSH HORIZONTAL AUTOMATIC SPRINKLER HEAD

CROSS REFERENCE TO RELATED APPLICATION

This application is a continuation-in-part of my prior application for Automatic Sprinkler Head, filed Nov. 10, 1982, Ser. No. 440,539.

BACKGROUND OF THE INVENTION

1. Field of the Invention

This invention relates to a flush pendant or flush horizontal sidewall automatic sprinkler head.

2. Description of the Prior Art

Various automatic spinklers have heretofore been disclosed which are responsive to a fusible element, but none of these has proven wholly satisfactory.

SUMMARY OF THE INVENTION

An automatic sprinkler head is provided in which the discharge of the water to and through the head is controlled by a fusible element.

It is the principal object of the invention to provide an automatic sprinkler head which is responsive to a fusible element.

It is a further object of the invention to provide an automatic sprinkler head in which a better flow of liquid is attained when the sprinkler is in operation.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
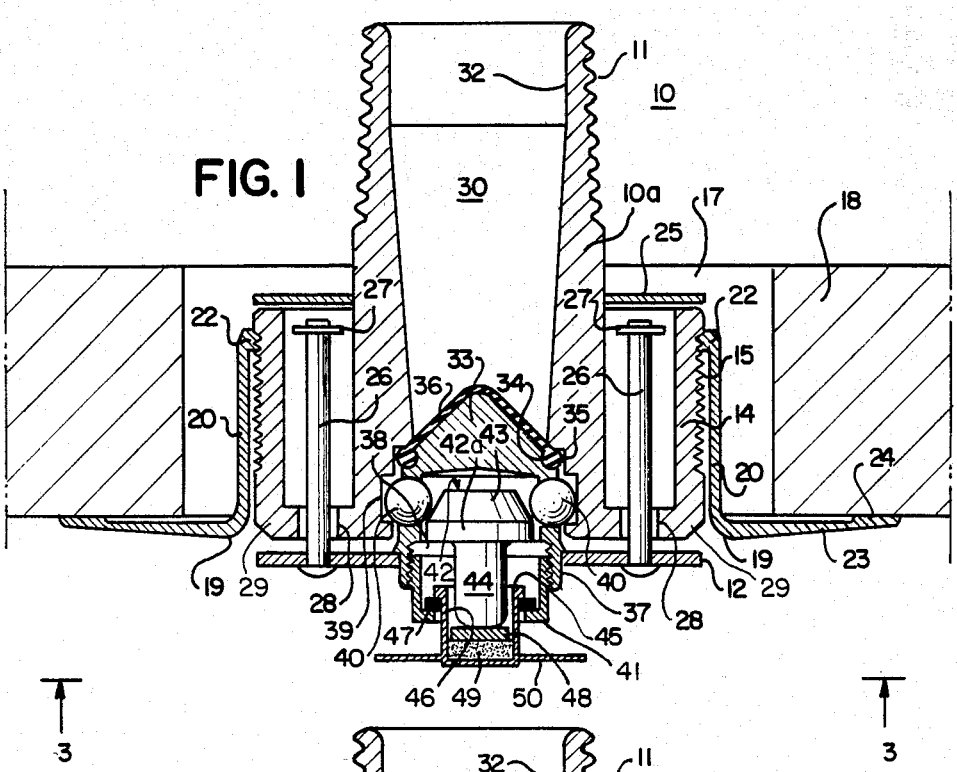
FIG. 1 is a vertical sectional view showing an automatic sprinkler in accordance with the invention in its normal position.

It should, of course, be understood that the description and drawings herein are illustrative merely, and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, the sprinkler head 10, in accordance with the invention, has a body portion 10*a* provided with a threaded portion 11 for attachment to a supply line (not shown). A plate 12 is provided having a plurality of slotted openings 13. An outer housing 14 is provided having a threaded portion 15. A hole 17 is provided in the ceiling 18.

A cover 19 is provided for the ceiling opening 17 which includes a tubular portion 20 with an inwardly extending flange 22 for engagement with the threaded portion 15, and an outwardly extending flange 23 and a rib 24 for engagement with the ceiling 18.

In covering relation to the outer housing 14, a plate 25 is provided.

Within the housing 14, a plurality of downwardly extending rods 26 are provided having washers 27 secured thereto, the rods 26 being secured at their lower ends to the plate 12. The rods 26 extend through openings 28 in the flange 29 which is integral with the body portion 10*a*.

The body portion 10*a* is an interiorly tapered portion 30 in communication with an interior cylindrical portion 32, and within the interior of the body portion 10*a*, a valve plug 33 is provided having a packing ring 34 in a groove 35.

The packing ring 34 has extending over the valve plug 33 a covering portion 36 to enhance the seal. The valve plug 33 has a downwardly extending internally threaded rim 37 with which also the cylindrical recess 38 is engaged. The lower part of the cylindrical portion 10*a* has a groove 39 for the reception of a plurality of locking balls 40.

The plate 12 is engaged with the downwardly extending internally threaded rim 37. Externally threaded sleeve 41 is in threaded engagement with the downwardly extending internally threaded rim 37.

A plunger 42 is provided and has a central portion 42*a* with a tapered section 43 for retaining the balls 40 in the groove 39.

The plunger 42 has a lower portion 44 slidable within a cylindrical portion 46 of the housing 45, which is separated from the sleeve 41 by an insulating ring 47.

The housing 45 contains within its cylindrical portion 46 an insulating disc 48, and a fusible element 49. The lower portion 44 of the plunger 42 rests on top of the insulating disc 48, which rests on top of the fusible element 49. It should be mentioned also that the housing 45 carries one or more cylindrical heat collecting fins 50.

Figure 2:
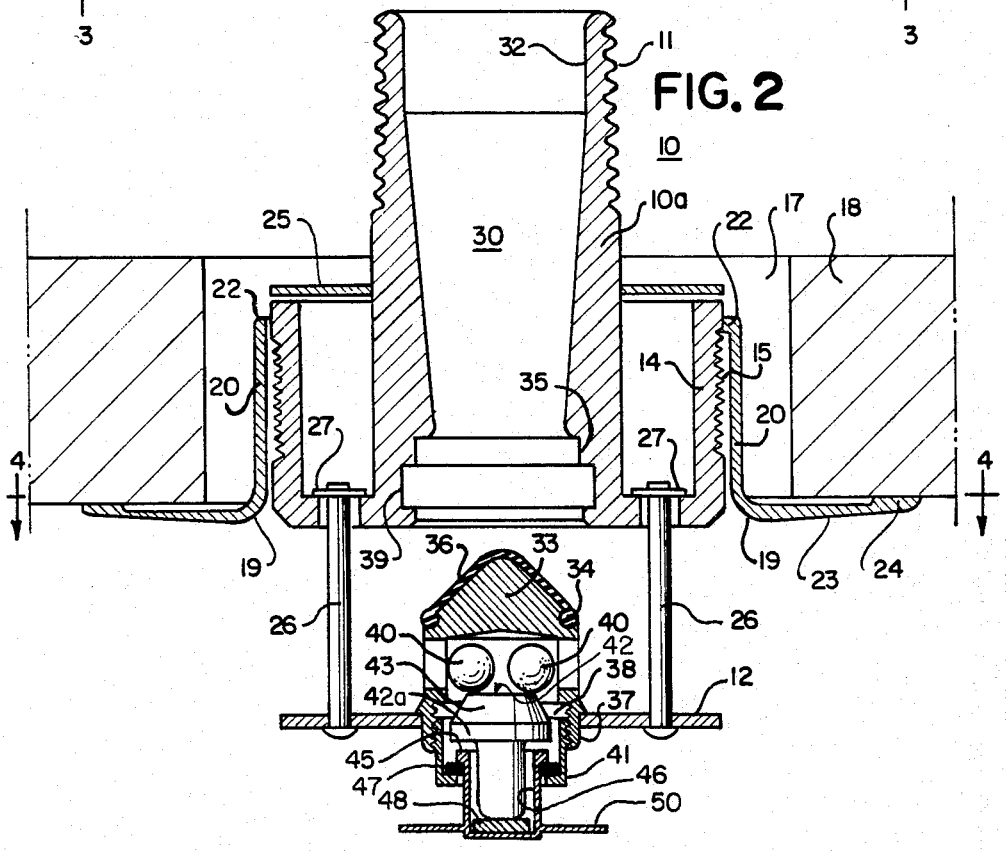
FIG. 2 is a vertical sectional view of an automatic sprinkler head in accordance with the invention in the discharge position.
Figure 3:
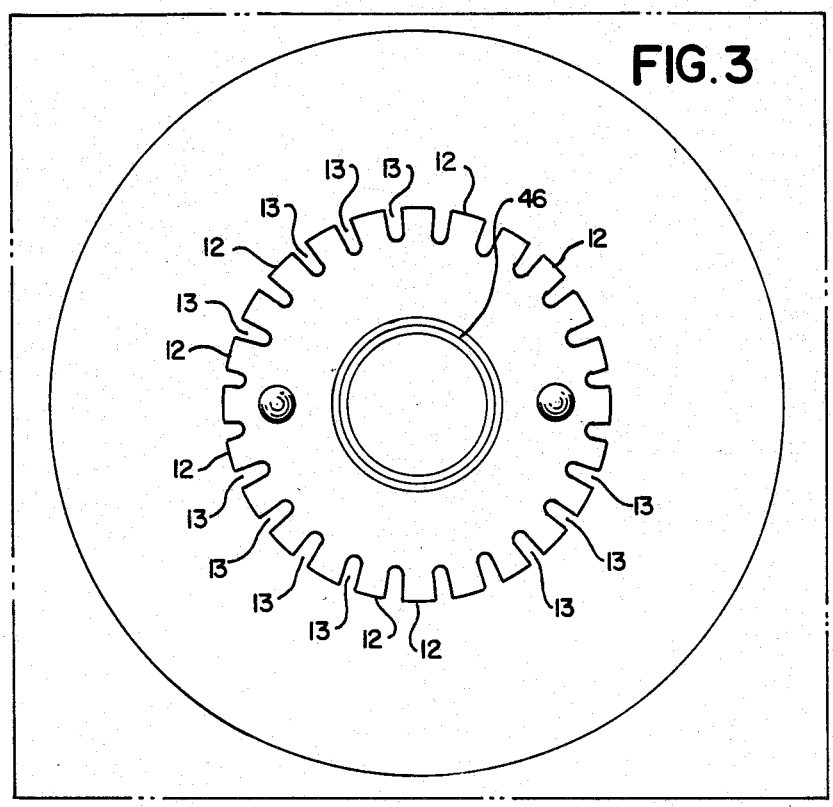
FIG. 3 is a horizontal sectional view taken approximately on the line 3—3 of FIG. 1.
Figure 4:
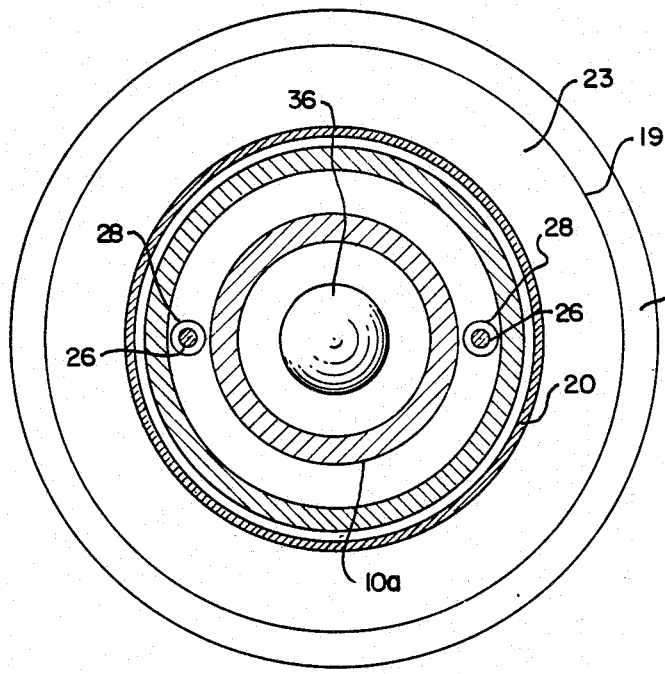
FIG. 4 is a horizontal plan view as seen from below.

As shown in FIG. 2, upon melting of the fusible element 49, the plunger 42 drops and permits the balls 40 to move from the groove 39 and inwardly with respect to the plunger 42 and the valve plug 33, so that the valve plug 33 and plunger 42 move downwardly together with the plate 12, and the rods 26.

I claim:

1. An automatic sprinkler head comprising:

a hollow body portion having an inlet at a first end for receiving a fluid and further having an outlet at a second end; said outlet having a seat;

a hollow valve plug having a plurality of balls therein and a plurality of slots through which the balls may travel, said plug engaging said seat in one position of said plug;

a housing having at least one fin, the housing being engaged with the valve plug for movement therewith;

a plunger disposed within the valve plug and the housing, said plunger contacting said balls;

a fusible metal element disposed within the housing and upon which the plunger rests; said balls preventing movement of said plug away from said seat until said element melts;

a deflector plate engaged with the valve plug for movement therewith;

a restraining guide means having at least one guide for guiding movement of the valve plug and the housing as a unit in relation to the seat of the hollow body portion without disengaging from the hollow body portion;

whereby melting of the fusible element permits said valve plug to move away from said seat thus permitting fluid to flow from said inlet to said outlet for discharge and deflection off said deflector plate.

2. An automatic sprinkler head as defined in claim 1 in which the balls travel inwardly into said plug when said element melts and said plunger is displaced.

3. An automatic sprinkler head as defined in claim 1 in which the housing is cylindrical.

4. An automatic sprinkler head as defined in claim 1 in which an insulator is disposed between the plunger and the fusible metal element.

5. An automatic sprinkler head as defined in claim 1 in which the housing is comprised of a first portion engaged with the valve plug and a second portion adjustably disposed within the first portion and contains the fusible metal element, and the plunger being disposed within the first and the second portions of the housing.

6. An automatic sprinkler head as defined within claim 5 in which an insulator ring is disposed between the first portion and the second portion.

7. An automatic sprinkler head as defined in claim 1 in which a sealant cover is disposed on the valve plug and between the valve plug and the seat.

8. An automatic sprinkler head as defined in claim 7 in which the sealant cover has a thicker annular ring at its outer periphery.

9. An automatic sprinkler head as defined in claim 1 in which the guide means have a restrainer disposed at their uppermost end.

10. An automatic sprinkler head as defined in claim 9 in which the restrainers are washers.

11. An automatic sprinkler head as defined in claim 1 in which the guide means are rods.

12. An automatic sprinkler head as defined in claim 1 in which the deflector plate has a plurality of slots.

* * * * *